US009139413B2

(12) United States Patent
Fedewa

(10) Patent No.: US 9,139,413 B2
(45) Date of Patent: Sep. 22, 2015

(54) FOAM REDUCING CONTAINER

(71) Applicant: David J. Fedewa, Haslett, MI (US)

(72) Inventor: David J. Fedewa, Haslett, MI (US)

( * ) Notice: Subject to any disclaimer, the term of this patent is extended or adjusted under 35 U.S.C. 154(b) by 260 days.

(21) Appl. No.: 13/838,167

(22) Filed: Mar. 15, 2013

(65) Prior Publication Data

US 2013/0255825 A1 Oct. 3, 2013

Related U.S. Application Data

(60) Provisional application No. 61/619,750, filed on Apr. 3, 2012.

(51) Int. Cl.

| | |
|---|---|
| ***B67D 1/08*** | (2006.01) |
| ***A47G 19/00*** | (2006.01) |
| ***A47G 19/12*** | (2006.01) |
| *A47G 19/22* | (2006.01) |

(52) U.S. Cl.

CPC ..... *B67D 1/0804* (2013.01); *A47G 19/00* (2013.01); *A47G 19/12* (2013.01); *A47G 19/2233* (2013.01); *B67D 2210/00065* (2013.01)

(58) Field of Classification Search

CPC ..... B67D 2210/00065; B67D 2210/00081
USPC ..... 141/2, 250, 266, 271–278, 369, 373, 141/377; 220/608, 623; 215/382
See application file for complete search history.

(56) References Cited

U.S. PATENT DOCUMENTS

| | | | | | |
|---|---|---|---|---|---|
| 2,170,311 | A | * | 8/1939 | Smith | 220/575 |
| 2,189,136 | A | * | 2/1940 | Dolphin | 215/382 |
| 2,215,691 | A | * | 9/1940 | East | 220/501 |
| 2,468,661 | A | * | 4/1949 | Gladstone | 222/130 |
| 2,805,561 | A | * | 9/1957 | Emmert et al. | 222/131 |
| 2,921,706 | A | * | 1/1960 | Johnson | 215/12.1 |
| 3,205,678 | A | * | 9/1965 | Stoner | 62/457.4 |
| 3,589,542 | A | * | 6/1971 | Dillon | 215/382 |
| 3,861,565 | A | * | 1/1975 | Rickmeier, Jr. | 222/131 |
| 4,655,373 | A | * | 4/1987 | Essen | 222/465.1 |
| 4,718,565 | A | * | 1/1988 | Zimmermann | 215/382 |
| 4,957,224 | A | | 9/1990 | Kessler et al. | |
| 5,086,817 | A | * | 2/1992 | Murphy | 141/271 |
| 5,267,669 | A | * | 12/1993 | Dixon et al. | 222/173 |
| 5,289,953 | A | | 3/1994 | McMillan, III et al. | |
| 5,335,705 | A | * | 8/1994 | Morishita et al. | 141/275 |
| 5,487,486 | A | * | 1/1996 | Meneo | 220/504 |
| 5,845,807 | A | | 12/1998 | De Villiers | |
| 6,065,603 | A | * | 5/2000 | Filice et al. | 206/519 |
| D444,987 | S | * | 7/2001 | McGrath et al. | D7/319 |
| 6,295,831 | B1 | * | 10/2001 | Watson | 62/457.3 |
| 6,755,328 | B1 | | 6/2004 | Franco | |
| D501,354 | S | * | 2/2005 | Graves et al. | D7/316 |
| 7,748,417 | B2 | * | 7/2010 | Arcuri | 141/198 |
| 8,678,215 | B2 | * | 3/2014 | Steiger et al. | 215/398 |
| 2012/0248117 | A1 | * | 10/2012 | Corbett et al. | 220/495.06 |

* cited by examiner

*Primary Examiner* — Timothy L Maust
(74) *Attorney, Agent, or Firm* — Endurance Law Group, PLC

(57) ABSTRACT

A foam reducing container for reducing the level of foam created when pouring a carbonated liquid into the container. The foam reduction container generally includes the container body having sidewalls extending from a base and the sidewalls defining at least one impact sloped wall for receiving a beverage poured from a delivery system.

13 Claims, 8 Drawing Sheets

FOAM REDUCING CONTAINER

CROSS-REFERENCE TO RELATED APPLICATIONS

This application claims priority benefit to provisional patent application No. 61/619,750 filed Apr. 3, 2012, the subject matter of which is incorporated by reference in its entirety.

FIELD OF THE INVENTION

The invention is directed towards relates generally to containers and more specifically carbonated beverage containers or vessels, particularly a foam reducing container for reducing the level of foam created when pouring a carbonated liquid into the container.

BACKGROUND

It is well known that carbonated beverages create foam when being poured from a pressurized system into a glass, pitcher, or other container prior to consumption. This foam generates waste of the beverage and ultimately wasted cost of the product. If poured directly into a pitcher for example, beer, will create a highly undesirable quantity of foam. One way to somewhat reduce foam generation is to manually angle a pitcher such that the beer will enter the pitcher hitting a sidewall will filling. This requires attending by a bartender or the like and restricts his or her ability to perform other tasks. Moreover, foam is still created even if reduced compared to a pitcher sitting flat below an exit spout of the beer tap.

Systems exist that deliver the beverage directly to the bottom of the container without the impact of a traditional pour. However, these systems are highly expensive and require an overhaul of a bar beverage delivery system. Accordingly, a need exists for a container adapted to reduce foam when pouring a beverage into the container.

SUMMARY

The present disclosure relates to a beverage container including: (a) a vessel defining an interior space having a front and rear side, the vessel having a base and sidewalls surrounding the interior space, the sidewalls extending upward from the base and sized and shaped to retain a liquid beverage; and (b) an opening defined at a top portion of the vessel to allow for the liquid beverage to enter and exit the interior space. The sidewalls define at least one angled section relative to a vertical axis, the angled section extending from the top portion to the base of the vessel inward towards the interior space and forming a curved intersection with an interior floor formed on top of the base. The angled section intersection with the interior floor is formed to be suitable to reduce foam production from a carbonated beverage when entering the interior space of the vessel.

In an example, the sidewalls are formed to reduce foam production when a carbonated beverage enters the vessel when the container rests flat on a surface below a carbonated beverage delivery system. The carbonated beverage delivery system can be a keg and tap system. In a further example, the foam produced when filling the beverage container resting flat under the carbonated beverage delivery system is one inch or less. In yet another example, a handle is formed on an exterior surface of the vessel on the rear side of the vessel, and wherein the handle is formed along the vertical axis of the vessel and sized and shaped to allow manual maneuvering of the vessel for lifting and pouring. The angled section can be defined on the rear side or a front side of the vessel.

In even yet another example, a target indicia is defined on the angled section, wherein target indicia is located at a position such that the carbonated beverage upon entering the vessel contacting the indicia first allows for reduced foam production as the vessel is filled with the carbonated beverage. The vessel can be a beer pitcher adapted to reduce foam production as beer is poured into the pitcher.

The present disclosure further provides for a method of reducing foam production created in pouring a carbonated beverage into a container, the method comprising the steps of: (a) placing a beverage container below a carbonated beverage delivery system, the beverage container having a vessel defining a front and rear side and sidewalls surrounding an interior space of the vessel and at least one angled section of the sidewalls sized and shaped to form a curved intersection with a bottom floor of the beverage container, the beverage delivery system having a beverage tap that releases carbonated beverage when engaged; and (b) contacting the carbonated beverage with the angled section of the sidewalls of the container until while partially or fully filling the beverage container with the carbonated beverage.

The present disclosure provides for an insert device adapted to cooperate with a standard beverage pitcher comprising: (a) an curved and angled unitary portion having at least one angled section relative to a vertical axis, the angled section extending from the top portion to a lower section corresponding to a top and lower section of a corresponding beverage pitcher, the angle extending inward towards an interior space of the beverage pitcher; and a hanging feature extending above the curved and angled unitary portion sized and shaped to mount onto a rim of the beverage pitcher. The angled section is formed to be suitable to reduce foam production from a carbonated beverage when entering the interior space of the vessel.

An object of the present disclosure is to provide a foam reduction container for reducing the level of foam created when pouring a carbonated liquid into the container.

Another object is to provide a foam reduction container that speed up the process of pouring carbonated liquid into a container.

Another objective of the foam reduction container is to have a slope in the side wall of the container that is not perpendicular to the base of the container.

Another objective of the foam reduction container is to pour the carbonated liquid down the slope of the side wall into the container where it settles, with a lower level of foam production relative to a conventional pitcher or beverage container.

Another object of the foam reduction container is to pour the carbonated liquid absent a user holding the container while the container rests on a surface below a spout from which the liquid is delivered thereby freeing the hands of the user to attend to other tasks such as pouring additional drinks, collecting money, retrieving additional orders, or delivering additional orders.

Other objects and advantages of the present disclosure will become obvious to the reader and it is intended that these objects and advantages are within the scope of the present disclosure. To the accomplishment of the above and related objects, this present disclosure may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present disclosure will become fully appreciated as the same becomes better understood when considered in conjunction with the accompanying drawings, in which like reference characters designate the same or similar parts throughout the several views, and wherein.

DETAILED DESCRIPTION

Figure 1:
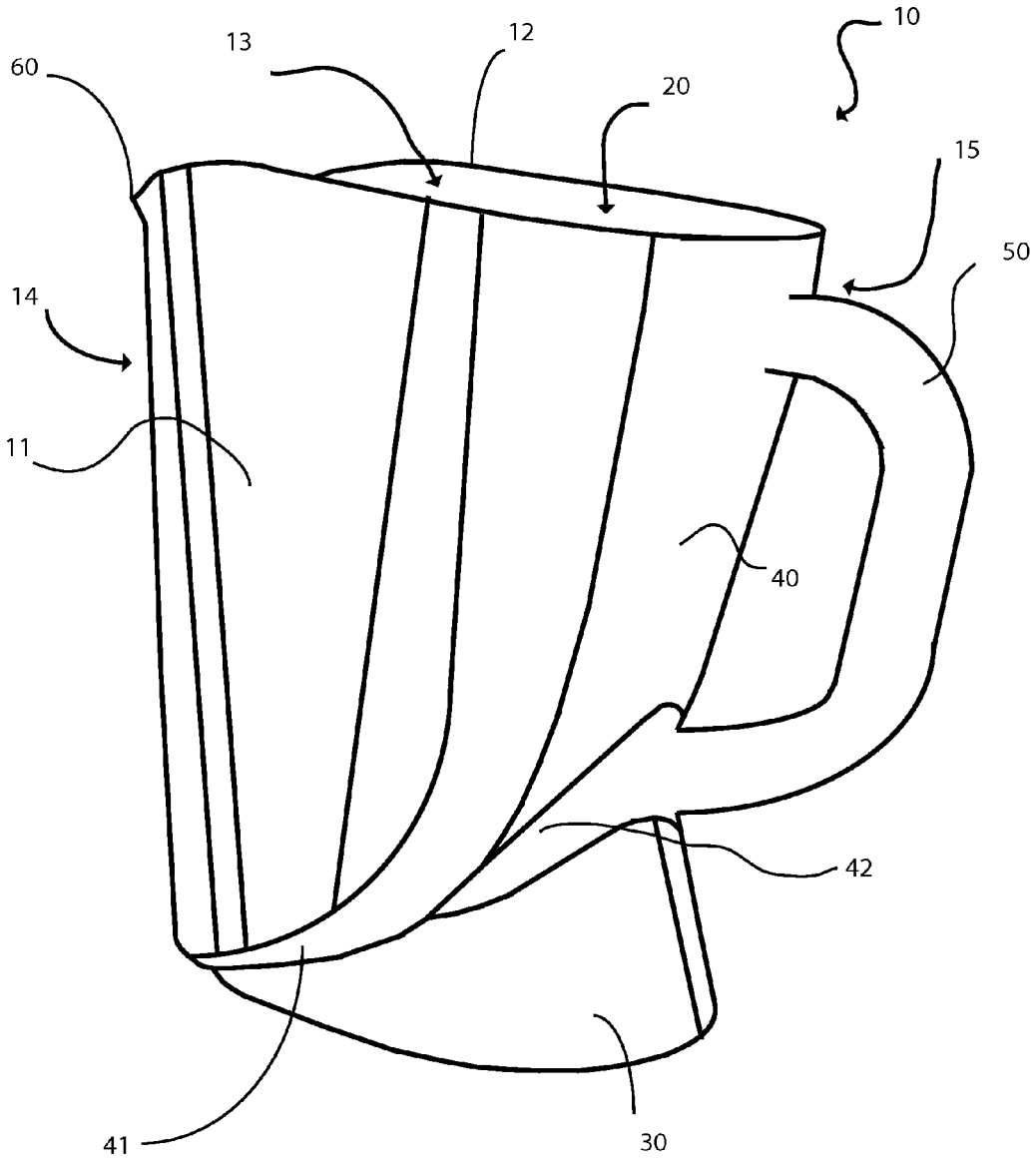
FIG. 1 is a perspective rear side view of an exemplary beverage container of the present disclosure.
Figure 2:
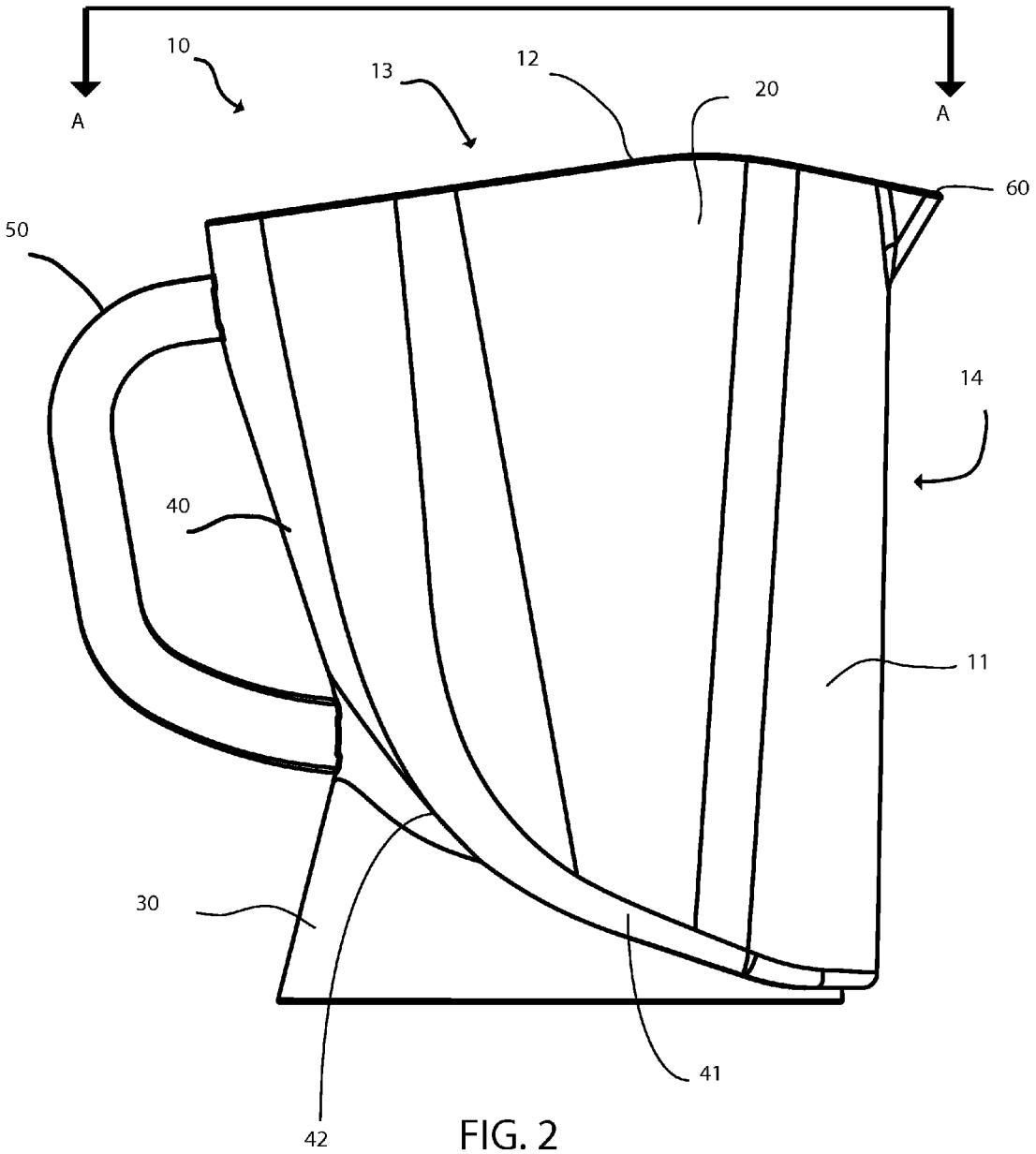
FIG. 2 is a side view of the exemplary beverage container of FIG. 1.
Figure 3:
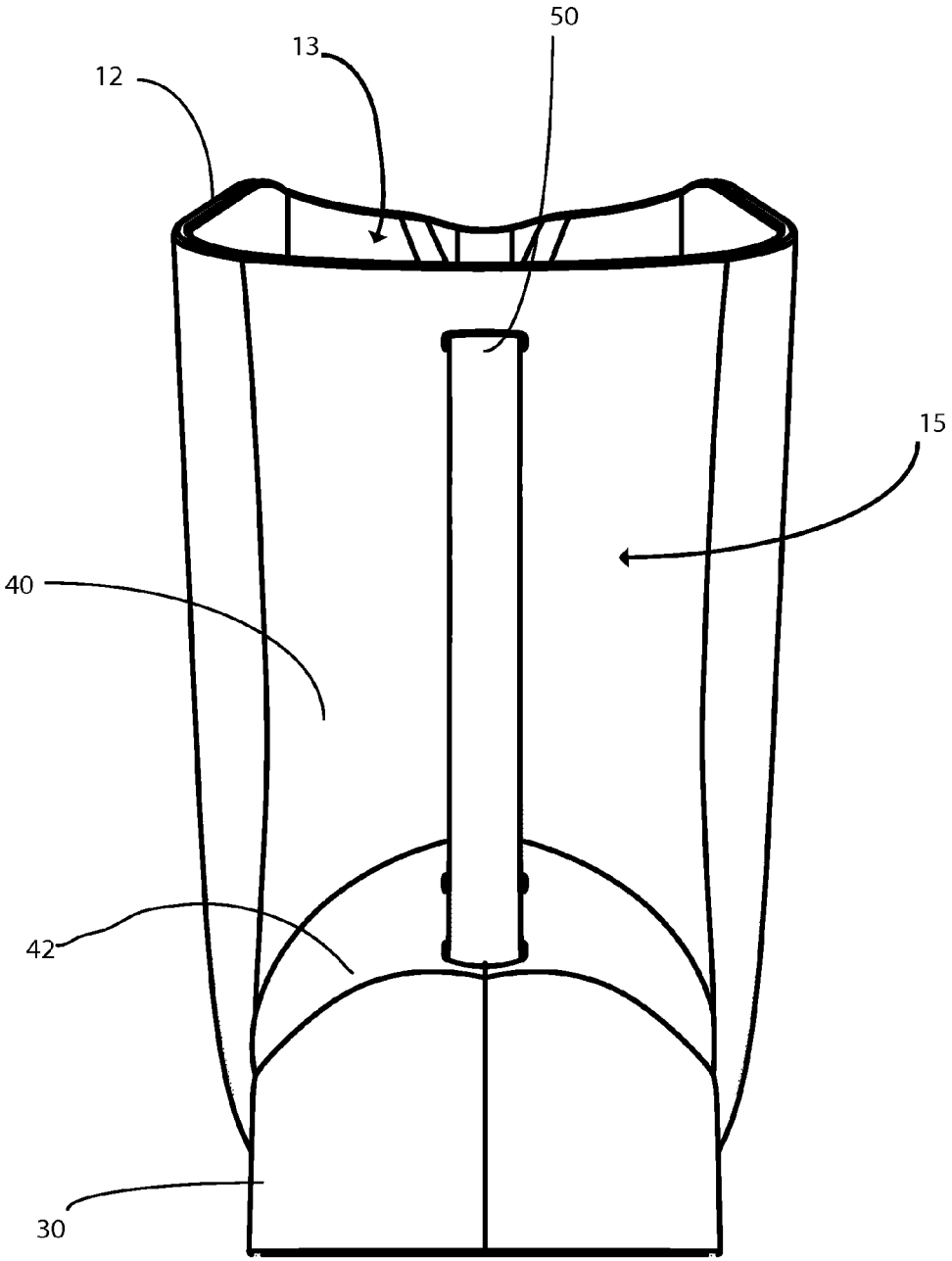
FIG. 3 is a rear/handle side view of the exemplary beverage container of FIG. 1.
Figure 4:
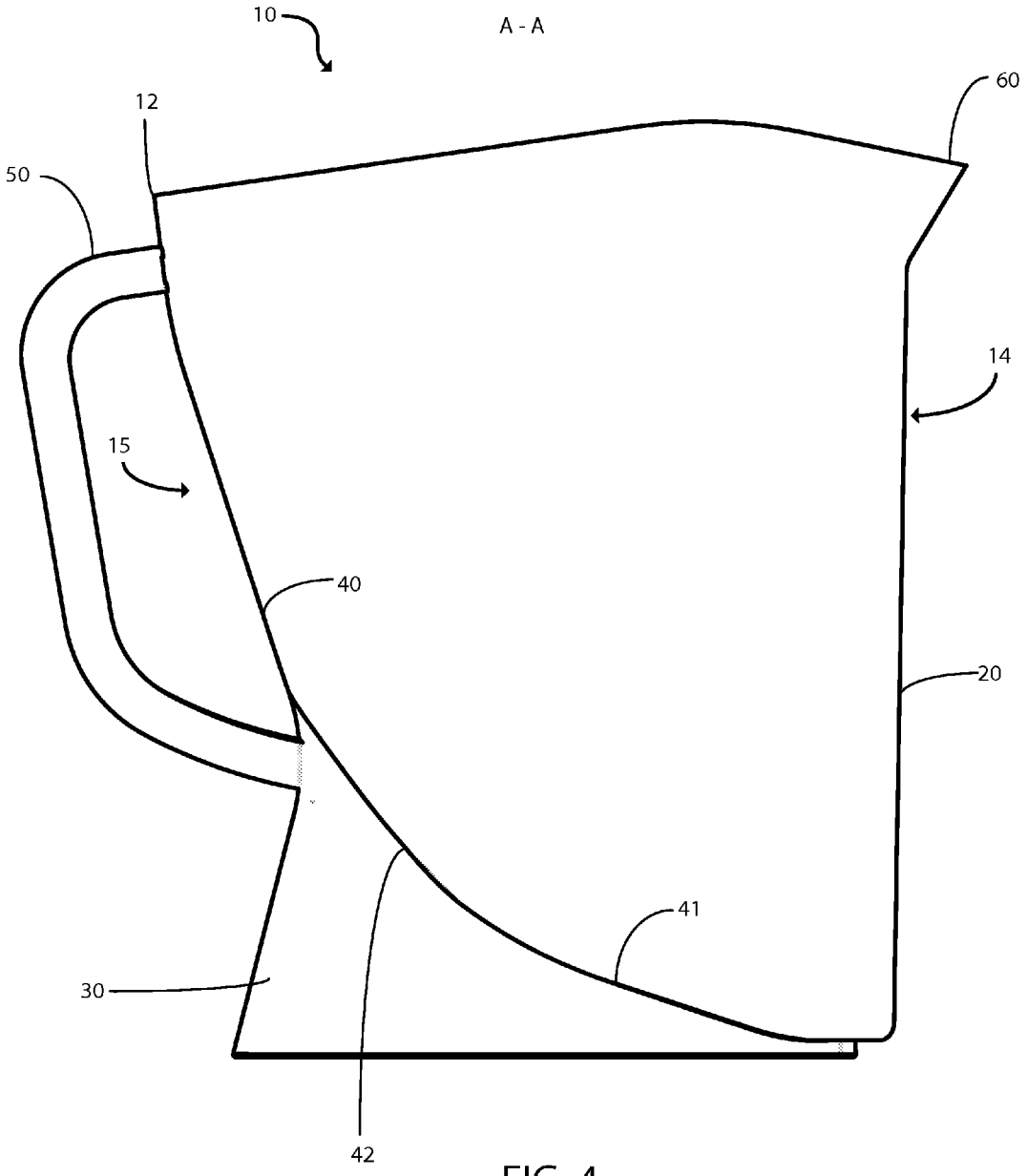
FIG. 4 is cross section view across plane A-A of FIG. 2 of the of the exemplary beverage container of FIG. 1.

Referring to FIGS. 1-4, the present disclosure generally relates to a beverage container 10 that includes a vessel 11 for receiving and pouring a beverage. Vessel 11 includes sidewalls 20 that surround an interior space 13 sized to be filled with a liquid beverage. Sidewalls 20 extend upwardly from a base 30. Base 30 is provided to securely support and balance container 10 when resting on a relatively horizontal surface. Base 30 can be weighted to provide sturdy balancing of container 10 when resting on a surface such as a table or bar.

Vessel 11 defines an upper rim 12 at a top section of the vessel. Rim 12 forms an opening to the interior space 13. Vessel 11 further defines a front side 14 and a rear side 15. In these examples, container 10 further includes a handle 50. Handle 50 is formed on an exterior surface of vessel 11 on rear side 15. The handle is sized and shaped to allow for manual handling of container 10. This includes lifting, carrying, pouring and other maneuvering of container 10. Handle 50 can include any standard handle of known beverage pitchers and the like.

In this example, vessel 11 further includes a pouring spout 60 defined on the front side 14 along the rim 12. The pouring spout 60 extends partially further outward from rim 12 to allow for liquid to pour effectively out from vessel 11.

The sidewalls 20 include at least one angled section 40. Angled section 40 extends from rim 12 to an interior curved floor 41 defined on an interior surface of vessel 11. Interior floor 41 defines a further shallower curvature extending in a curvilinear fashion from angled section 40 towards. Accordingly, as angled section 40 defines an angle relative to a vertical axis defined by the vessel 11, the slope decreases relative to a horizontal axis defined be the base 30. Angled section 40 and curved floor 41 intersect at an intersection portion 42 in a smooth fashion adapted to allow liquid to gently fill the interior space 13 of vessel 11.

Figure 6:
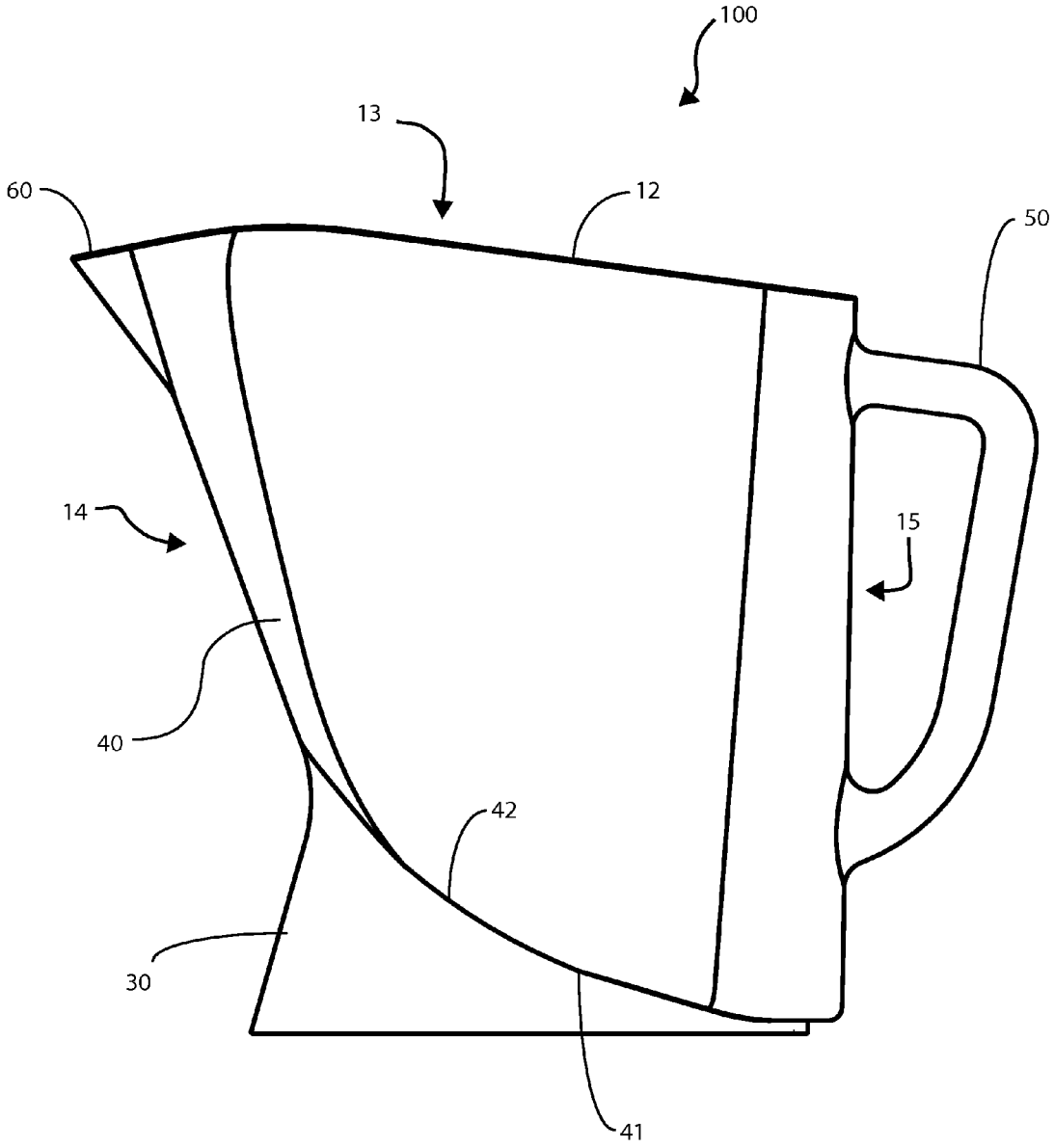
FIG. 6: illustrates a side view of an alternative embodiment according to the present disclosure wherein the front spout side face is angled.

In the examples of FIGS. 1-4, angled section 40 is formed along a rear side 15. Front side 14 is formed substantially vertically extending from base 30. Curved floor 41 is defined on top of base 30. In an alternative embodiment of a container 100 of FIG. 6, the angled section 40 is formed on front side 14. Like reference numerals are used to define like features of container 100 as compared to container 10.

Figure 5:
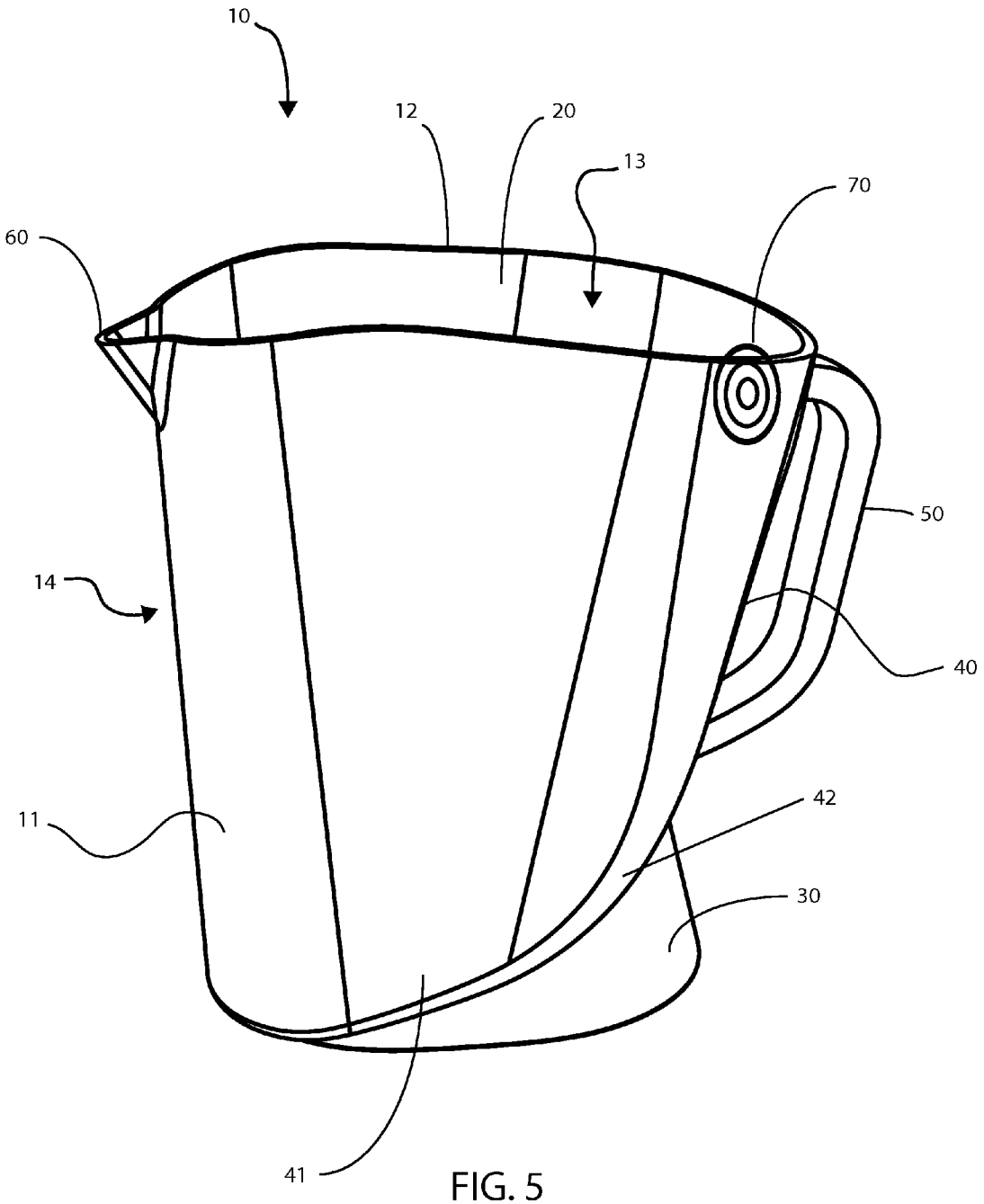
FIG. 5 illustrates a side view of an example beverage container according to the present disclosure having a target indicia defined on a rear side wall.

Referring to an example of FIG. 5, a target indicia 70 is provided and defined on angled section 40. In this example, the target indicia is defined near a top section of angled section 40 near rim 12. Target indicia is located in a position such that when a carbonated beverage contacts the target indicia area first, foam production is reduced as container 10 is filled with a carbonated beverage. In a further example, target indicia 70 defines a desired image or promotional material such as a logo or design for a particular business or establishment.

Figure 7:
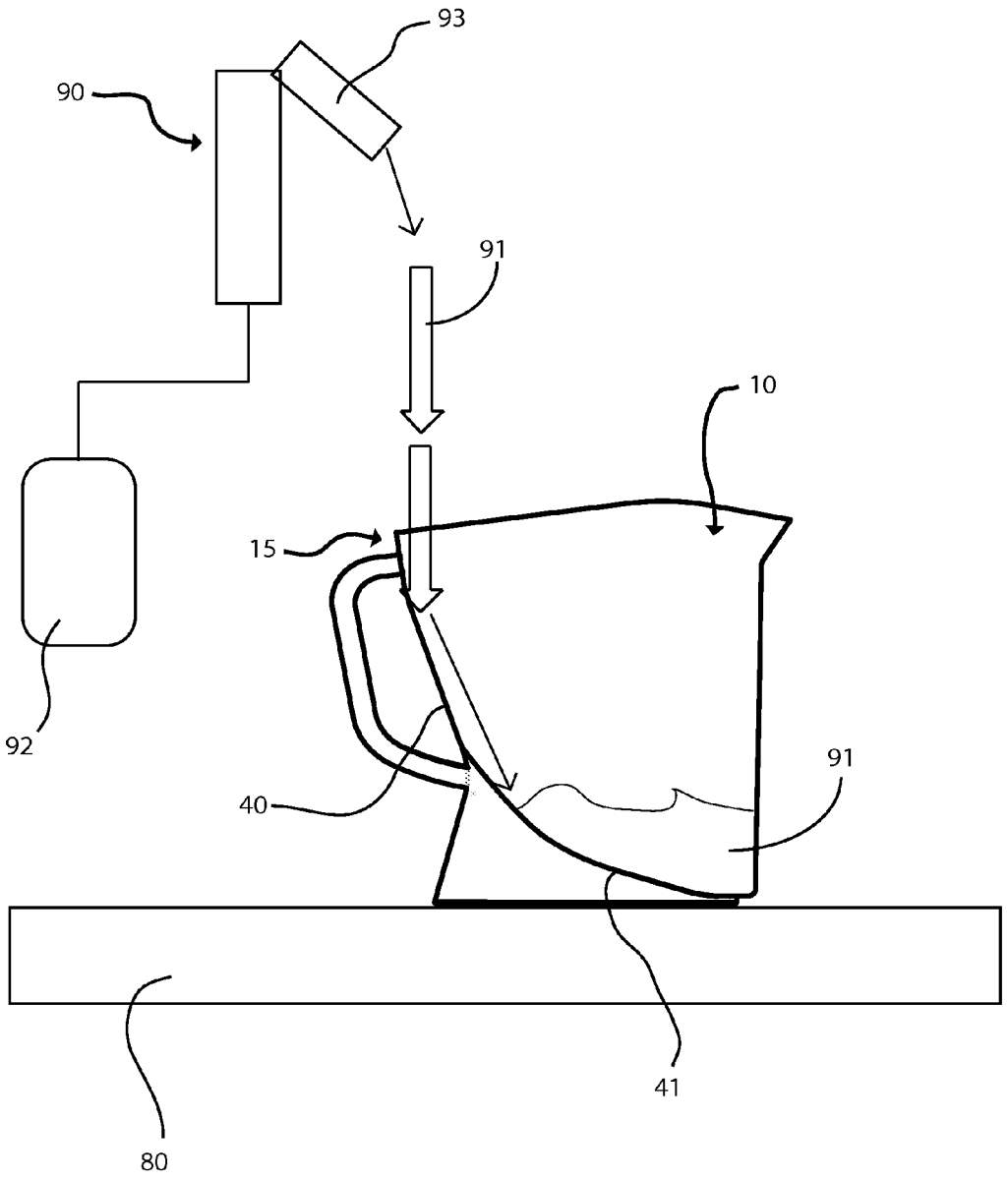
FIG. 7 illustrates an schematic example of the container of FIG. 1 in use with a beverage delivery system.

The container can be any beverage container including a pitcher suitable for holding any beverage such as beer, soda pop, or the like. The container typically defines a cavity or interior space formed within an opening at an opposite end of the container from the base. The container can be filled by direct pouring in one example and in another example placed directly under a spout of a beverage tap adapted to deliver a beverage by engaging the tap. In FIG. 7, an example bar 80 defines a substantially flat surface for placing a container 10. In this illustration of a container in use, container 10 is placed below a carbonated beverage delivery system 90 that is connected to a beverage storage unit 92 for storing beverage 91. An example storage unit is a keg for storing beer or other carbonated beverages. System 90 includes a dispensing unit 93. An example dispensing unit 93 includes a tap for releasing the beverage 91. In this illustration, beverage 91 dispenses into container 10 flowing with gravity in a downward direction. Beverage 91 enters container 10 by contacting the angled portion 40 of the sidewalls 20. In this example, angled section 40 is defined on the rear side 15. As beverage 91 contacts angled section 40 of container 10, the beverage flow is slowed in velocity as it fills vessel 11. This slowing of the beverage reduces liquid disruption that causes unwanted foam production. The flow continues to be slowed as the slope angle changes to a more shallow position towards floor 41.

Container 10 can be any structure that you can receive, hold, and/or pour a liquid, particularly a consumable beverage, and more particularly a carbonated beverage such as beer or soda. The function of the container 10 can be for users to hold liquid to either consume or distribute. For example container 10 can be a glass, mug, pitcher, cup, or anything that holds liquid. Sidewalls 20 of container 10 holds the liquid from escaping the container 10 and in general extend upward from the base 30 and can be composed of any material and be in any shape. In an example, container 10 is formed as an integral unit from a suitable plastic material. This can be achieved through any means such as injection molding or the like.

Sidewalls 20 typically are vertical or semi vertical off the base 30. In an example, sidewall 20 is integrally formed with base 30. Base 30 of container 10 is the structure that holds the liquid from escaping from a bottom of container 10. The sloped angled section 40 defines a degree of projection of a portion of sidewall 20 and is to be from the upper region of the container 10 down to the lower region of the interior space 13 of vessel 11. The angled section 40 is formed along an interior surface of the vessel 11 leading down towards base 30. The slope can be composed in some embodiments of radiuses and angles. In an example embodiment of radiuses and angles to create the angled section 40, the slope can be defined by a 70 degree angle at a top portion of the pitcher leading down to the slope following a radius of 7¾ inches and the radius that leads into a flat surface at the bottom base of 6⅜ inches.

There are many different variations of the angled section 40. The slope 40 does not have to be a constant angle but it can be gradually curving as it approaches base 30. Angled section 40 includes an angled area that starts in the upper region of sidewalls 20 and leads down towards the base 30.

Figure 8A:
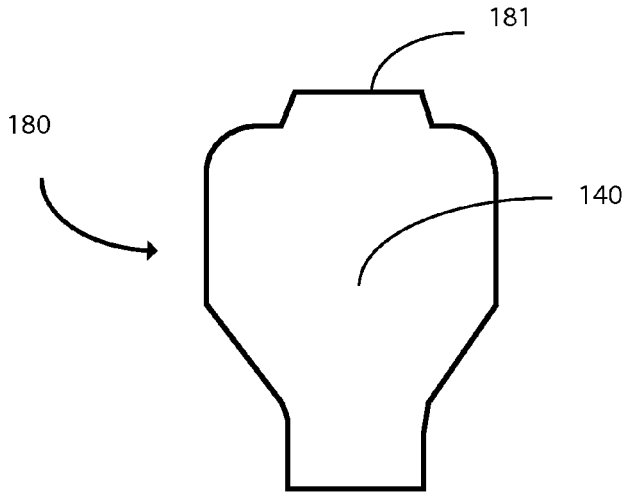
FIG. 8A-8C illustrates an example insert device according to the present disclosure.
Figure 8B:
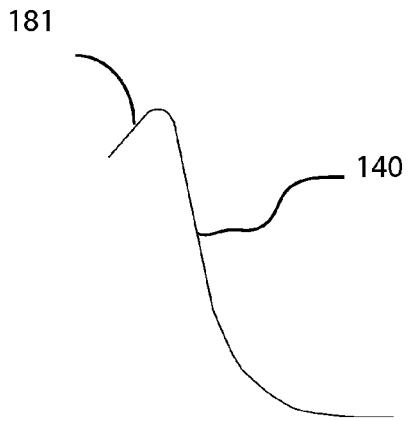
Figure 8C:
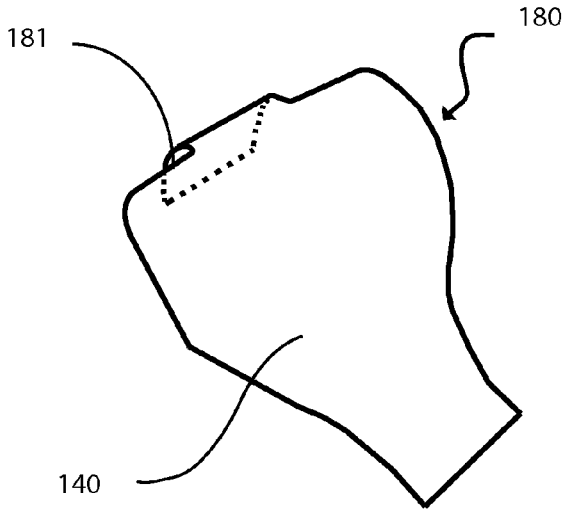

In a further example, an insert 180 that fits into existing containers and can be removed for use on other containers to reduce foaming (shown in FIGS. 8A-8C. The variation of the device would typically be made out of plastic or metal and would have the sloping shape similar to that of angled section 40 of container 10. Insert 180 includes a sloped angled section 140 and a hanging feature 181. The sloped angle of angled section 140 slows the velocity of a carbonated beverage when contacting the insert 180 first before entering the beverage container. Hanging feature 181 is sized and shaped to secure to a rim of a standard beverage container such as a beverage pitcher or beer pitcher. This device would then be inserted into a container and a carbonated liquid would be poured in and down the slop of the device and then the device removed after pouring the liquid. The device would then be used on other containers to reduce their foam levels when a liquid is poured into said container. A target indicia can also be provided in an example insert 180.

Typically, foam results when pouring a carbonated beverage into a container. The present disclosure creates a region of the container that the beverage can be poured down that lowers the level of foam that is created in the container. The way the present disclosure creates a lower level of foam in the container is by lowering the impact of the carbonated beverage with the container and lowering the impact of the carbonated beverage on itself that has already settled into the container. A container according to an example of the present disclosure includes a slope down the side wall of the container. When the container is sitting flat on a surface, a portion of the side wall defines a non-perpendicular slope relative to the base that extends from a position closer to an opening of the container and angling towards the base such that the radius or area of a cross section near the opening is larger than an area of a cross section of the base. This can lower the impact of the liquid into the bottom of the container.

Multiple slopes along the interior sidewall of an example container can be defined extending from the base to the opening. The slope can allow for reduced foam pouring into a container absent the presence of a user and by merely resting on a surface below the source of the beverage delivery, such as a spout of a beverage tap.

In an example, a bartender can use one or more of an example container described herein above to fill with a carbonated beverage such as beer which typically forms significant amounts of foam when poured into a standard container. The bartender can rest the container below a beer tap typically used in taverns and bars for delivering beer from a keg that is pressurized. The positioning the container is such that the beer is delivered from the tap in a downward direction into the container and by contacting the sloped portion of the interior wall surface prior to contacting the base of the container. The bartender is free from holding the container to reduce foam formation and can attend to other tasks while the beer is filling the container. The foam produced in the container is significantly reduced as compared to that of filling a standard container. This results in significant beverage savings and thus cost savings since foamed beer is wasted beer. Moreover, time savings are included resulting in freeing the bartender from the task of monitoring the container filling.

In yet a further example, the shape of the container forms a lower center of gravity as compared to existing containers and thus is less likely to tip over.

The following example illustrates pouring data associated with the present disclosure:

Pitcher Test Data

Test containers are 60 oz pitchers:

Conventional Pitcher set flat and filled after 20 seconds generated about 4.5 inches of foam.

Conventional pitcher held by a person and tilted at about a 45 degree angle after 20 seconds forms about 3 inches of foam.

Foam Reduction Pitcher example of the present disclosure set flat and filled after 20 seconds with about 1 inch of foam or less.

Many modifications and variations of the present invention are possible in light of the above teachings and may be practiced otherwise than as specifically described while within the scope of the invention.

What is claimed:

1. A beverage container comprising:

(a). a vessel defining an interior space, the vessel having a base and sidewalls surrounding the interior space, the sidewalls extending upward from the base and sized and shaped to retain a carbonated liquid beverage, the interior space of the vessel having a vertical centerline;

(b). an opening defined at a top portion of the sidewalls to allow for the liquid beverage to enter and exit the interior space;

wherein the sidewalls include a filling side passing through the vertical centerline of the interior space, the filling side being configured to gradually decelerate a downward stream of carbonated beverage from a tap dispenser prior to colliding with an opposite portion of the sidewalls, the filling side including an angled section extending from adjacent the top portion of the sidewalls diagonally toward the base of the vessel, the angled section being slanted to directly receive the downward stream of carbonated beverage from the tap dispenser, the filling side further including a curved intersection disposed between the angled section and an interior floor formed on top of the base;

wherein the angled section directs the carbonated beverage flow into the curved intersection where the in-flow of carbonated beverage is progressively slowed by traveling over an elongated arcuate surface while passing through the vertical centerline thereby reducing foam production from the carbonated beverage when entering the interior space of the vessel.

2. The beverage container of claim 1 further comprising a spout formed in the top portion, and a handle formed on an exterior surface of the vessel opposite the spout, and wherein the handle is formed on a rear side of the vessel for lifting and pouring, and the spout is formed on a front side of the vessel for directing a controlled outpouring of carbonated beverage through the opening.

3. The beverage container of claim 2 wherein the filling side is defined on the rear side of the vessel.

4. The beverage container of claim 2 wherein the filling side is defined on the front side of the vessel.

5. The beverage container of claim 1 further comprising a target indicia defined on the angled section, wherein target indicia is located at a position such that the carbonated beverage upon entering the vessel contacting the indicia first allows for reduced foam production as the vessel is filled with the carbonated beverage.

6. A method of reducing foam production created in pouring a carbonated beverage into a container, the method comprising the steps of:

(a). placing a beverage container below a tap dispenser of a carbonated beverage delivery system, the tap dispenser configured to selectively emit a stream of carbonated beverage with a downward velocity, said placing step including supporting a base of the beverage container in a generally horizontal position, the beverage container having a vessel defining a front and rear side and sidewalls surrounding an interior space of the vessel and at least one angled section of the sidewalls sized and shaped to form a curved intersection with a bottom floor of the beverage container, the interior space of the vessel having a vertical centerline;

(b). positioning the beverage container below the tap dispenser so that the stream of carbonated beverage initially strikes the angled surface; and (c). without tipping the beverage container below the tap dispenser, minimizing foam production by gradually slowing the velocity stream of the carbonated beverage along a flow path established by the angled section and the curved intersection that passes through the vertical centerline.

7. The method of claim 6 wherein the carbonated beverage delivery system includes a keg and tap system.

8. The method of claim 6 wherein foam produced when filling the beverage container resting flat under the carbonated beverage delivery system is one inch or less.

9. The method of claim 6 further comprising removing the beverage container from the horizontal support surface by manually grasping a handle formed on an exterior surface of the vessel on the rear side of the vessel.

10. The method of claim 6 wherein the angled section is defined on one of the front and rear side of the vessel.

11. The method of claim 6 further comprising a target indicia defined on the angled section, wherein target indicia is located at a position such that the carbonated beverage upon entering the vessel contacting the indicia first allows for reduced foam production as the vessel is filled with the carbonated beverage.

12. A combination standard beverage pitcher and insert device adapted to convert the standard beverage pitcher into a foam-reducing beverage pitcher, the combination comprising:

a beverage pitcher having an interior space defined by a base and sidewalls, a rim formed at the upper edges of the sidewalls, the interior space having a vertical centerline;

an insert device, the insert device including a curved and angled unitary portion configured to be placed generally diagonally within the interior space of the pitcher so as to traverse the vertical centerline above the base;

a hanging feature extending above the curved and angled unitary portion sized and shaped to mount onto the rim of the beverage pitcher;

wherein the curved and angled unitary portion first receives a downward stream of carbonated beverage from a tap dispenser and then decelerates the beverage flow as the flow travels an elongated path through the vertical center line thereby reducing foam production as the carbonated beverage fills the interior space.

13. The combination of claim 12 further comprising a target indicia defined on the angled section, wherein target indicia is located at a position such that the carbonated beverage upon entering the vessel contacting the indicia first allows for reduced foam production as the vessel is filled with the carbonated beverage.

* * * * *